US010532590B2

(12) United States Patent
Tamaki

(10) Patent No.: US 10,532,590 B2
(45) Date of Patent: Jan. 14, 2020

(54) PRINTING APPARATUS

(71) Applicant: SEIKO EPSON CORPORATION, Tokyo (JP)

(72) Inventor: Takayuki Tamaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/045,966

(22) Filed: Jul. 26, 2018

(65) Prior Publication Data

US 2019/0030921 A1 Jan. 31, 2019

(30) Foreign Application Priority Data

Jul. 28, 2017 (JP) ..... 2017-147019

(51) Int. Cl.
*B41J 11/02* (2006.01)
*B41J 11/00* (2006.01)

(52) U.S. Cl.
CPC ..... *B41J 11/02* (2013.01); *B41J 11/0045* (2013.01)

(58) Field of Classification Search
CPC ..... B41J 11/02; B41J 11/001; B41J 11/045; B41J 11/06
See application file for complete search history.

(56) References Cited

U.S. PATENT DOCUMENTS 6,736,501 B2 * 5/2004 Yamaguchi ..... B41J 11/06 347/104
7,040,825 B2 * 5/2006 Asada ..... B41J 11/0085 347/104
2013/0051854 A1 * 2/2013 Sakuma ..... G03G 15/1695 399/121

FOREIGN PATENT DOCUMENTS

JP 2013-006359 A 1/2013

* cited by examiner

*Primary Examiner* — Sharon A. Polk
(74) *Attorney, Agent, or Firm* — Workman Nydegger

(57) ABSTRACT

The printing apparatus includes a medium support member including a support surface that supports a sheet of paper on which printing is to be performed, and a positioning member that positions the support surface of the medium support member. The positioning member is a plate-shaped member and is configured to position the support surface of the medium support member, with the medium support member contacting with an end face intersecting a plate surface of the positioning member.

7 Claims, 9 Drawing Sheets

PRINTING APPARATUS

BACKGROUND

The present disclosure relates to a printing apparatus such as a printer.

There are liquid jetting apparatuses (printing apparatuses), such as printers, which jet a liquid such as ink from a head onto a medium such as a sheet of paper supported and conveyed on the support surface of a platen (medium support member), thus printing an image containing a character or the like on the medium.

One example of a platen (medium support member) used in such a liquid jetting apparatus (printing apparatus) includes a configuration in which the platen (medium support member) including a support surface including resin is superimposed on a platen base including resin (JP-A-2013-06359).

SUMMARY

In this type of printing apparatus including a resin platen (medium support member), in order to print on a large-sized medium (sheet), for example, the platen (medium support member) is lengthened in a lengthwise direction, which is a width direction orthogonal to a conveyance direction of the medium. In this case, there are instances where the platen (medium support member), which is a resin component, has significant curving of the support surface due to warping occurring in the lengthwise direction in conjunction with manufacturing (for example, injection molding). Therefore, there are cases where it is difficult to correct the warping to suppress curving of the support surface, or namely, to ensure flatness of the support surface.

This is generally common for all liquid jetting apparatuses (printing apparatuses) including a resin platen (medium support member) that include a support surface supporting a medium to be printed on.

Provided is a printing apparatus including a medium support member that includes a medium support surface which is suppressed curving.

The printing apparatus in one exemplary embodiment includes a medium support member including a support surface configured to support a sheet of paper on which printing is to be performed, and a positioning member configured to position the support surface of the medium support member. The positioning member is a plate-shaped member, and the positioning member is configured to position the support surface of the medium support member, with the medium support member contacting with an end face of the positioning member, the end face of the positioning member intersecting a plate surface of the positioning member.

Because the positioning member positions the support surface with reference to the end face intersecting the plate surface of the plate-shaped member and the end face having smaller area than the area had by the plate surface, this configuration makes it possible to easily ensure a flatness of the end surface as a surface to which the support surface positioned with reference, and allows for precise positioning. In the printing apparatus, the positioning member may include metal.

With this configuration, positioning is performed with the end face of the plate-shaped member. Because curving deformation in the direction normal to the end face of the plate-shaped member is suppressed, this configuration makes it possible for the support surface of the medium to be a surface for which curving is suppressed. Furthermore, when the positioning member includes metal, the positioning member has strong rigidity against curving in the direction normal to the end face of the plate-shaped member.

In the printing apparatus, the end face of the positioning member includes an engaging part. The medium support member includes an engaged part with which the engaging part engages. When the engaged part engaged by the engaging part, the support surface is positioned in the direction normal to the support surface.

With this configuration, the medium support member is positioned in the direction normal to the support surface. And this configuration makes it easier that the support surface is a surface for which curving is suppressed. In the printing apparatus, the medium support member may include resin, and the engaged part may include a projecting part. The projecting part is crushed by the end face of the positioning member when the engaging part engaging with the engaged part.

With this configuration, the medium support member is positioned without gaps in the direction normal to the support surface, and thus the support surface is a surface for which curving is suppressed. In the printing apparatus, the medium support member may include a plurality of engaged parts, one of the plurality of engaged parts including a first projecting part and the other of the plurality of engaged parts including a second projecting part, and the first projecting part and the second projecting part may be arranged so that crushing the first projecting part and crushing the second projecting part do not occur simultaneously.

Because crushing does not occur at the same time during the engaging part engaging the engaged part on which projecting part is formed, this configuration makes it possible to suppress an increase in the workload during engaging via crushing of the projecting part when the positioning member engages with the medium support member.

In the printing apparatus, the medium support member may include a first medium support member and a second medium support member. The first medium support member includes a first engaged part and the second medium support member includes a second engaged part. The engaging part of the positioning member engages with the first engaged part and the second engaged part.

Because one engaging part of the positioning member engages with the engaged part of two different medium support members, this configuration makes it possible for the support surfaces of the two different medium support members to include an identical surface.

BRIEF DESCRIPTION OF THE DRAWINGS

The disclosure will be described with reference to the accompanying drawings, wherein like numbers reference like elements.

FIG. 2 is a perspective view illustrating a medium support member including a support surface that supports a medium to be printed on.

DESCRIPTION OF EXEMPLARY EMBODIMENTS

Figure 1:
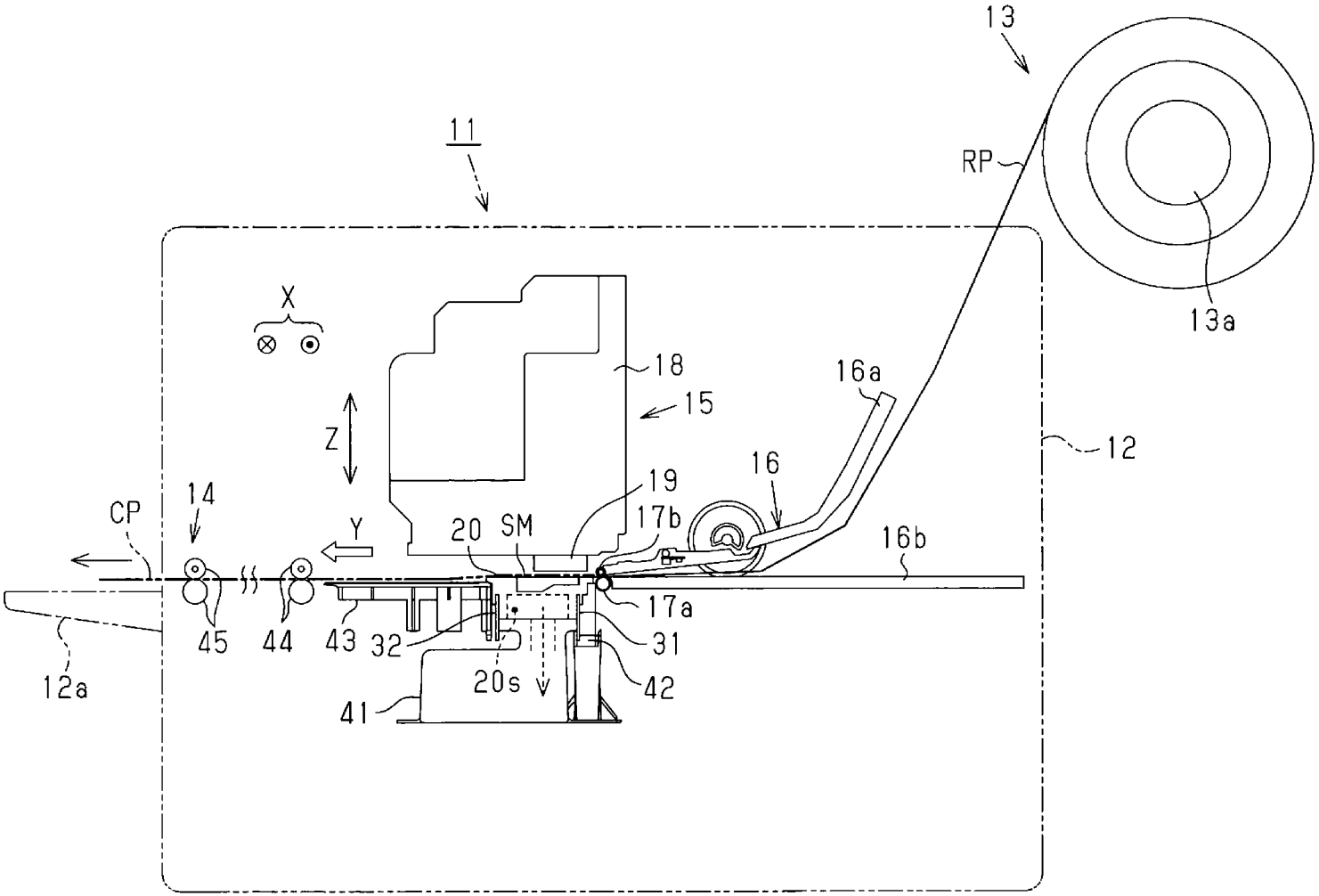
FIG. 1 is a side view schematically illustrating a configuration of a printing apparatus in some exemplary embodiments.

One exemplary embodiment of the printing apparatus will be described below with reference to the drawings. As illustrated in FIG. 1, the printing apparatus 11 in some exemplary embodiments is an ink jet printer that jets ink, which is one example of a liquid, onto a sheet of paper (for example, roll paper), which is one example of a medium, in order to print an image or the like containing a character, pattern, etc.

In other words, the printing apparatus 11 includes a main casing 12 and a paper feed unit 13. The paper feed unit 13 includes a long-sized sheet of paper RP, which is supplied to the main case 12, in a roll state in which a sheet of paper is wound around a roll shaft 13*a*. The inside of the main case 12 includes a liquid jetting unit 15 and a paper discharge unit 14. The liquid jetting unit 15 jets ink onto the supplied sheet of paper RP to print an image or the like. The paper discharge unit 14 discharges the sheet of paper RP on which the image or the like is printed as cut paper CP from a paper exit provided in the main case 12 to a paper discharge tray 12*a*. The paper feed unit 13 is provided on a side of the main case 12 opposite to the paper discharge unit 14 such that the sheet of paper RP is rotatable about a roll axis 13*a*. The paper feed unit 13 supplies the sheet of paper RP into the main case 12.

A conveyance path 16 is provided inside the main case 12. The conveyance path 16 includes guide members 16*a* and 16*b* where a distal end of the sheet of paper RP is guided, and the like. The distal end of the sheet of paper RP, which is supplied while being unwound from a rolled state in conjunction with the rotation of the roll axis 13*a*, is conveyed along this conveyance path 16. The sheet of paper RP is fed in a conveyance direction between a pair of rollers, or namely, a paper feed roller 17*a* and a paper pressing roller 17*b*. The paper feed roller 17*a* is provided on the downstream side of the conveyance path 16. The paper pressing roller 17*b* operates in conjunction with the rotation of the paper feed roller 17*a*. The sheet of paper RP is sandwiched by the paper feed roller 17*a* and the paper pressing roller 17*b* while conveyed to the liquid jetting unit 15 positioned in the downstream side of the conveyance direction. The paper feed roller 17*a* is driven by a drive source (not illustrated) (a motor, for example). Therefore, in some exemplary embodiments, the paper feed roller 17*a* and the paper pressing roller 17*b* function as a conveyance unit and convey the sheet of paper RP in a conveyance direction Y.

The liquid jetting unit 15 includes a cartridge 18 on an upper side (anti-gravity direction side) in a vertical direction Z of the sheet of paper RP to be conveyed. The cartridge 18 is supported by a guide shaft (not illustrated) and is movable along the guide shaft. The guide shaft is installed inside the main case 12 in a state extending in a substantially horizontal direction along a width direction of the sheet of paper RP orthogonal to the conveyance direction Y (in FIG. 1, the depth direction of the sheet surface). Attached to the cartridge 18 is a liquid jetting head 19 on a bottom surface side facing the sheet of paper RP to be conveyed. The liquid jetting head 19 includes a plurality of nozzles (not illustrated) that jet ink. The nozzles move back and forth along the width direction of the sheet of paper RP while the cartridge 18 is guided by the guide shaft, thus moving back and forth with the cartridge 18 in a scanning direction X along the guide shaft.

Furthermore, the printing apparatus 11 includes a medium support member 20 including resin at a position facing the liquid jetting head 19 with the sheet of paper RP to be conveyed interposed between. The medium support member 20 supports, from a lower side (gravity direction side), the sheet of paper RP on which printing is performed. The medium support member 20 has a substantially rectangular surface of which an upper surface facing the liquid jetting head 19 has the scanning direction X as the lengthwise direction. The medium support member 20 suctions and supports the sheet of paper RP on the upper surface through negative pressure applied to the medium support member 20. Thus, on the upper surface of the medium support member 20, the surface supporting the sheet of paper RP is a support surface SM. In one exemplary embodiment, the support surface SM is a surface that follows a substantially horizontal direction. Therefore, a direction normal to the support surface SM is a direction that follows the vertical direction Z.

The printing apparatus 11 also includes positioning members 31 and 32. The positioning members 31 and 32 position the support surface SM of the medium support member 20 relative to the liquid jetting head 19 (refer to FIG. 3). The positioning members 31 and 32 are plate-shaped members. In the conveyance direction Y of the sheet of paper RP supported and conveyed on the medium support member 20, the positioning member 31 is provided on an upstream side, and the positioning member 32 is provided on a downstream side. The support surface SM of the medium support member 20 is positioned with reference to an end face extending in a direction intersecting the plate surfaces of the positioning members 31 and 32. In other words, the end face of the positioning member 32 intersects the plate surface of the positioning member 32, and the positioning member 32 positions the support surface SM with the medium support member 20 contacting with the end face of the positioning member 32. The medium support member 20 includes an inner space 20*s* on a lower side opposite to a liquid jetting head 19 side. Negative pressure is applied to the inner space 20*s* in order to adsorb the sheet of paper RP onto the support surface SM via a negative pressure generating unit 41 which includes a suction fan or the like connected to the medium support member 20.

Ink is jetted from the liquid jetting head 19 onto a surface, or namely, an upper surface of the sheet of paper RP adsorbed onto the medium support member 20 and supported on the support surface SM, thus printing an image or the like by the ink adhering to the sheet of paper RP. When borderless printing is to be performed in the printing apparatus 11, an ink discharge unit 42 is provided, which is where ink that has been jetted onto the medium support member 20 is discharged.

The printing apparatus 11 includes a guide plate 43 and a pair of intermediate rollers 44 inside the main case 12 for conveying the sheet of paper RP from the medium support member 20 side to the paper discharge unit 14 side on the downstream side in the conveyance direction Y with respect to the medium support member 20. In addition, the printing apparatus includes a pair of paper discharge rollers 45 that discharge the sheet of paper RP from the paper exit to the paper discharge tray 12*a*. A drying device or the like for drying the ink by blowing warm air (dry air) onto a printing surface of the cut paper CP is provided as appropriate between the pair of intermediate rollers 44 and the pair of paper discharge rollers 45 at a cutter that cuts the sheet of paper RP on which an image has been formed into a cut paper CP of a predetermined length, or on the downstream side in the conveyance direction Y with respect to the cutter.

Figure 2:
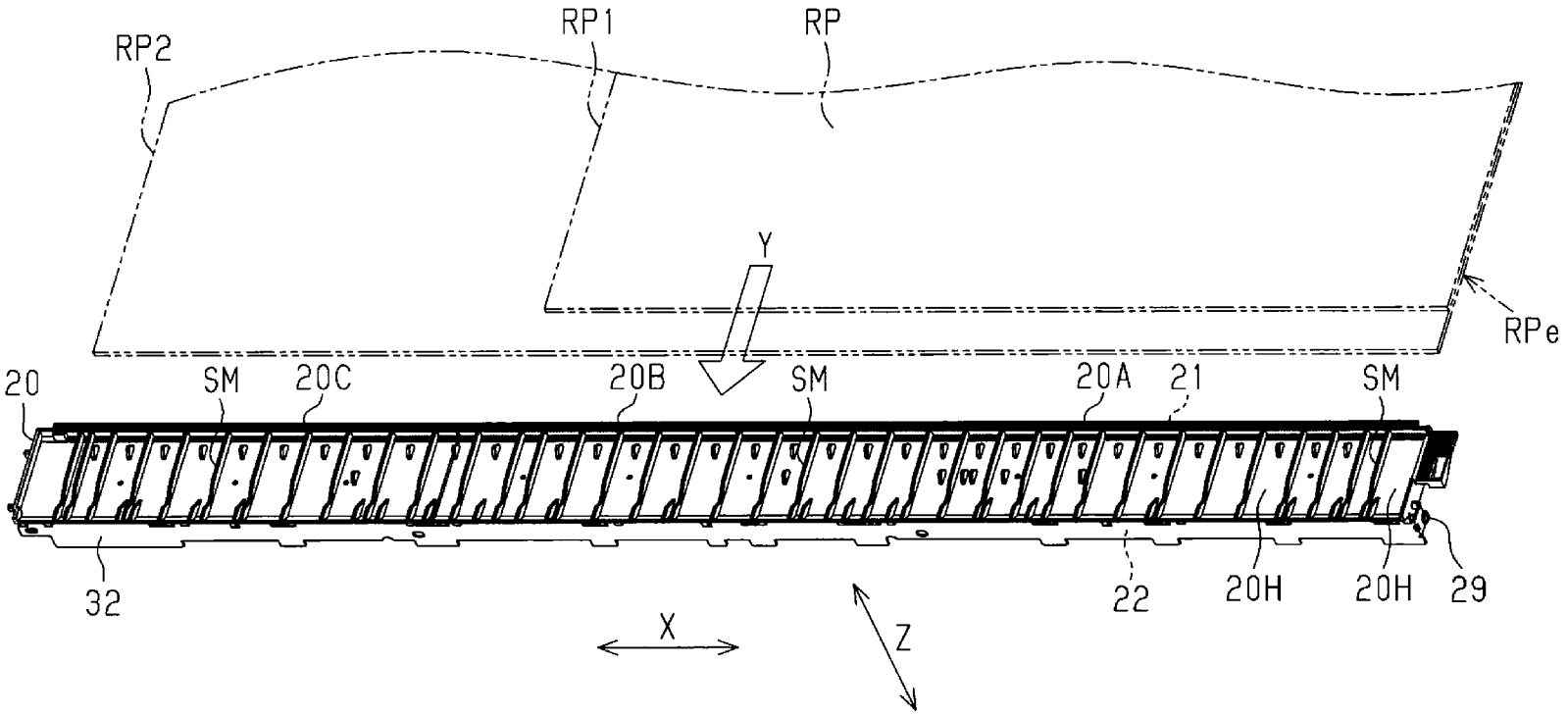

As illustrated in FIG. 2, the medium support member 20 including the support surface SM that supports the sheet of paper RP to be conveyed includes a plurality of recesses 20H arranged next to one another in the width direction orthogonal to the conveyance direction Y of the sheet of paper RP. The recesses 20H open on the support surface SM and each recess downward by a predetermined amount so as to be separated from the supported sheet of paper RP. In other words, in one exemplary embodiment, the recesses 20H are provided in positions corresponding to the ends in the width direction of a plurality of sheets of paper RP with different width dimensions, such as sheets of paper with large width dimensions (roll paper, for example) and sheets of paper with small width dimensions (roll paper, for example). As seen from the downstream side in the conveyance direction Y, the recesses 20H provided on a rightmost side are all provided in positions in common with and corresponding to respective ends RPe on a right side as seen from the downstream side in the conveyance direction Y of a sheet of paper RP1 and a sheet of paper RP2 which have different width dimensions and are supported on the medium support member 20, for example. In other words, each sheet of paper RP is conveyed on the medium support member 20 while deviated to the right side as seen from the downstream side in the conveyance direction Y, such that one end RPe of each sheet of paper RP are all positioned at an identical reference position.

In one exemplary embodiment, the medium support member 20 supports a sheet of paper RP with a largest width dimension (here, a sheet of paper RP2) with the support surface SM, and thus the length in the width direction needs to be greater (here, the length in the scanning direction X). In one exemplary embodiment, due to reasons pertaining to manufacturing and the like, the medium support member 20, which is long in the width direction in this manner, includes three divided members, or namely, a medium support member 20A, medium support member 20B, and medium support member 20C.

Figure 4:
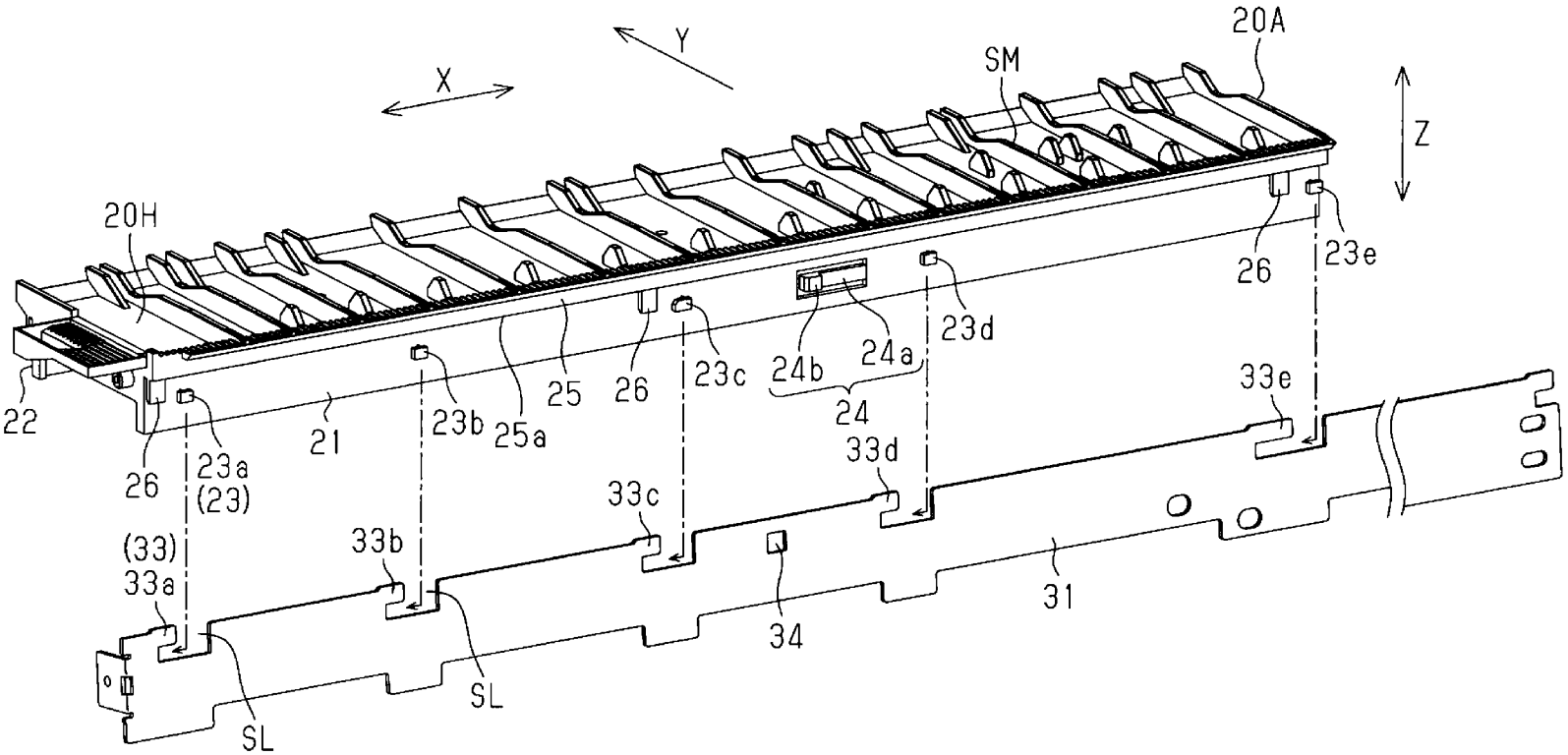
FIG. 4 is a perspective view illustrating the positioning member and the medium support member.

These three members are each provided with an upstream-side wall 21 and a downstream-side wall 22 on the upstream side and the downstream side of the sheet of paper RP in the conveyance direction, and the walls include a wall surface substantially orthogonal to the support surface SM (refer to FIG. 4). The upstream-side wall 21 and downstream-side wall 22 of each of the medium support member 20A, medium support member 20B, and medium support member 20C are respectively attached to the positioning member 31 and positioning member 32. This provides the medium support member 20A, medium support member 20B, and medium support member 20C in parallel, and forms the support surface SM of the medium support member 20.

Figure 3:
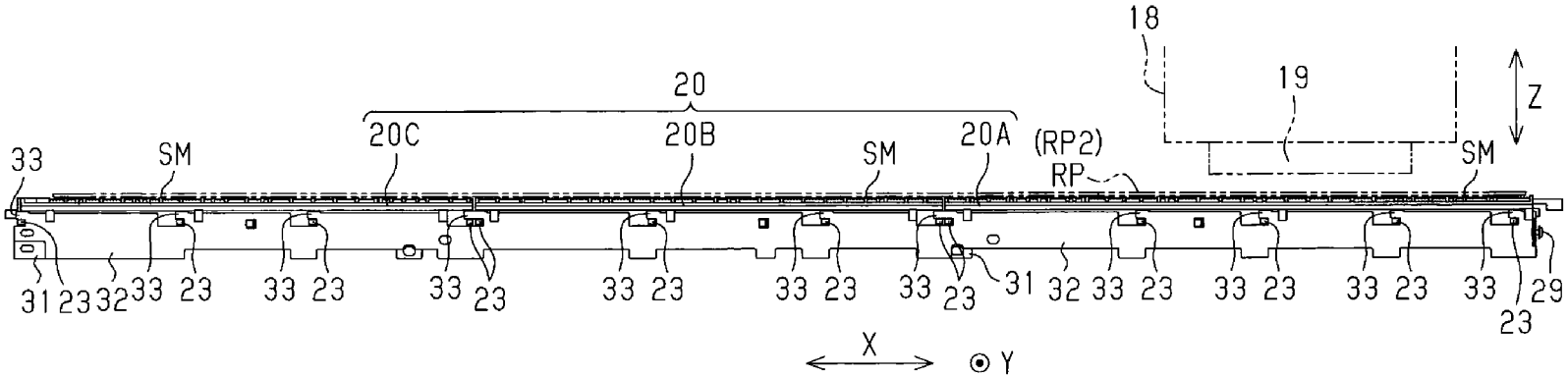
FIG. 3 is a front view illustrating a positioning member that positions the support surface of the medium support member.

As illustrated in FIG. 3, the medium support member 20A, medium support member 20B, and medium support member 20C forming the medium support member 20 each include the downstream-side wall 22 attached to one positioning member 32, and each include the upstream-side wall 21 attached to the other positioning member 31 (refer to FIG. 4). In other words, one positioning member 32 is attached to each of the downstream-side walls 22, and the other positioning member 31 is attached to each of the upstream-side walls 21.

Figure 5:
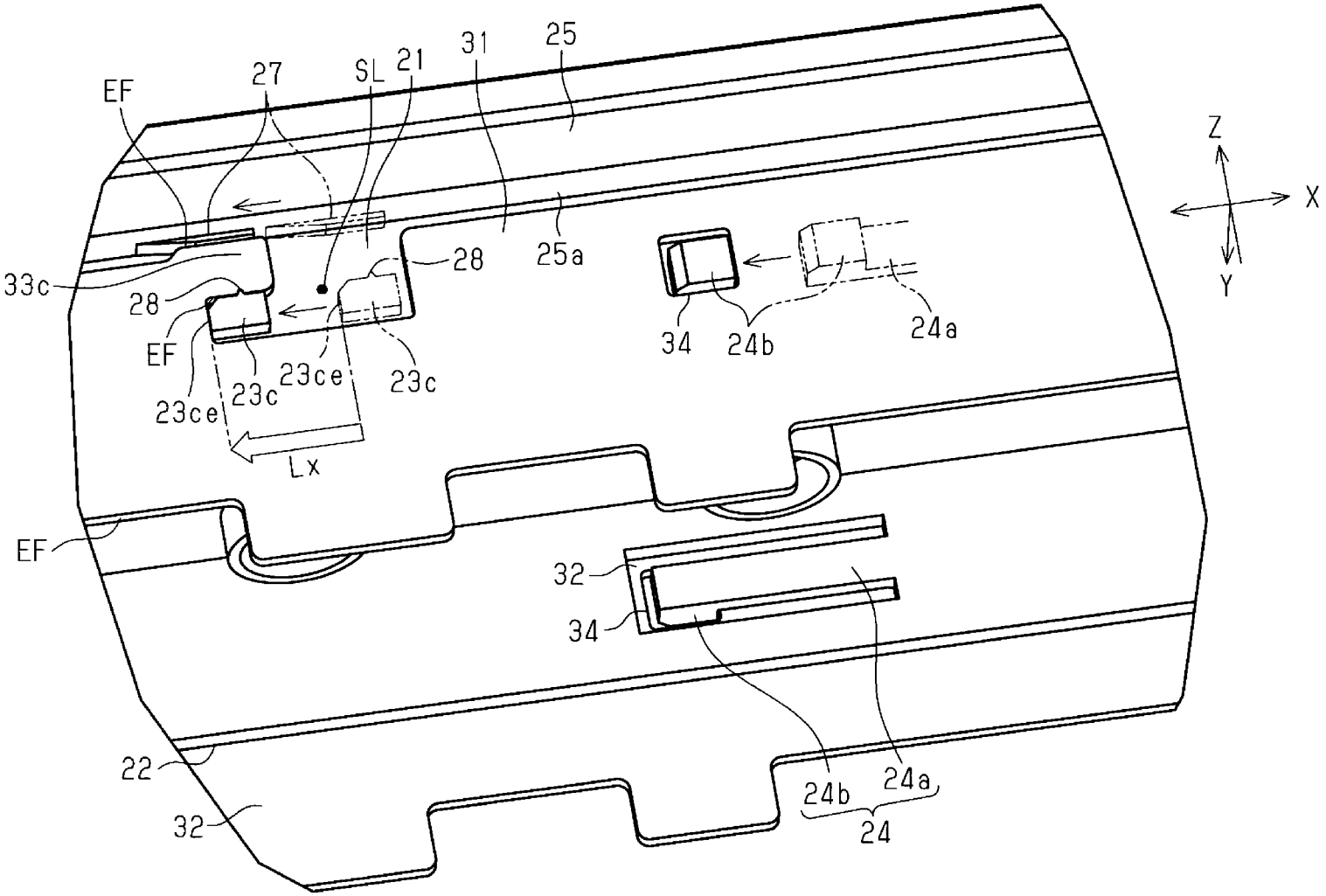
FIG. 5 is a perspective view illustrating one example of an engaging part of the positioning member and an engaged part of the medium support member.

In one exemplary embodiment, a plurality of extension-shaped parts 33 engage a plurality of protruding parts 23 and a plurality of convex ribs 27 (refer to FIG. 5). The plurality of extension-shaped parts 33 is one example of engaging parts provided on the positioning members 31 and 32. The plurality of protruding parts 23 is one example of engaged parts, which are provided on the medium support member 20 respectively corresponding to the plurality of extension-shaped parts 33. The convex ribs 27 face the plurality of protruding parts 23. Through the engaging described above, the medium support member 20A, medium support member 20B, and medium support member 20C forming the medium support member 20 are attached to the positioning members 31 and 32. After attachment, a screw 29 fixes the medium support member 20 (in FIG. 8, medium support member 20A) to the positioning members 31 and 32.

In this manner, the medium support member 20A, medium support member 20B, and medium support member 20C that form the medium support member 20 being attached to the two positioning members 31 and 32 position the support surface SM of the medium support member 20 which supports the sheet of paper RP. In particular, in one exemplary embodiment, the support surface SM is positioned in the vertical direction Z relative to the liquid jetting head 19, which moves in the scanning direction X along with the cartridge 18.

Positioning of the support surface SM by the positioning members 31 and 32 will be described by using the medium support member 20A and upstream-side positioning member 31 as an example. The configuration described below is similar to the positioning configuration of the support surface SM between the medium support member 20A and downstream-side positioning member 32. Moreover, the configuration is similar to the positioning of the support surface SM by the positioning members 31 and 32 on the medium support member 20B or medium support member 20C.

As illustrated in FIG. 4, the medium support member 20A includes five protruding parts 23 protruding a predetermined amount from the upstream-side wall 21 toward the upstream side in the conveyance direction Y. In one exemplary embodiment, for convenience of explanation, the five protruding parts 23 are distinguished, in order from the left side seen from an upstream side in the conveyance direction Y, as protruding parts 23*a*, 23*b*, 23*c*, 23*d*, and 23*e*. Meanwhile, the positioning member 31 includes five extension-shaped parts 33 that extend in the scanning direction X so as to form slits SL having an L shape, the top of which is an opening into which the respective protruding parts 23*a*, 23*b*, 23*c*, 23*d*, and 23*e* can be inserted. In one exemplary embodiment, for convenience of explanation, the five protruding parts 33 are distinguished, in order from the left side seen from the upstream side in the conveyance direction Y, as protruding parts 33*a*, 33*b*, 33*c*, 33*d*, and 33*e*.

Furthermore, the medium support member 20A includes a hook 24, on the upstream-side wall 21, which includes a lever part 24*a* that is a cantilever-like shape of which one end (base end) in the scanning direction X is fixed to the upstream-side wall 21, and a cuboid-shaped convex part 24*b* on the other end (distal end) in the scanning direction X protruding from the upstream-side wall 21 toward the upstream side in the conveyance direction Y. Meanwhile, the positioning member 31 includes a rectangular hole 34 into which the convex part 24*b* of the hook 24 can be inserted.

In addition, the medium support member 20A includes an eaves part 25. The eaves part 25 extends on the upper part of the upstream-side wall 21 along the scanning direction X and protrudes from the upstream-side wall 21 toward the upstream side in the conveyance direction Y. Plate-shaped ribs 26 are formed protruding downward from an eaves surface 25*a* on the bottom side of the eaves part 25 in the center and vicinity of both ends of the eaves part 25 in the scanning direction X. The plate-shaped ribs 26 include gaps with the upstream-side wall 21 equivalent to the plate thickness of the positioning member 31 and into which the positioning member 31 can be inserted (refer to FIG. 5).

In one exemplary embodiment, as illustrated by the dotted-dashed arrow in FIG. 4, the protruding parts 23*a*, 23*b*, 23*c*, 23*d*, and 23*e* of the medium support member 20A are respectively insertable into the slits SL in the positioning member 31 from above in the vertical direction Z. At this time, the positioning member 31 is inserted between the upstream-side wall 21 of the medium support member 20A and the plate-shaped rib 26. After insertion, the protruding parts 23*a*, 23*b*, 23*c*, 23*d*, and 23*e* of the medium support member 20A are movable along the scanning direction X in L-shaped slits SL of the positioning member 31. Due to the protruding parts 23*a*, 23*b*, 23*c*, 23*d*, and 23*e* of the medium support member 20A moving in the scanning direction X of the slits SL, the upper surface portions of each of the protruding parts 23*a*, 23*b*, 23*c*, 23*d*, and 23*e* are positioned by the positioning member 31, thus positioning the support surface SM of the medium support member 20A.

The positioning of the support surface SM will be described with reference to the drawings. As illustrated in FIG. 5, in one example, the protruding part 23*c* moves from being inserted into a slit SL as illustrated by the double dotted-dashed line in FIG. 5 along the scanning direction X as illustrated by the bold arrows in FIG. 5. Due to this, the protruding part 23*c* moves up to the bottom side of an extension-shaped part 33*c*.

In the movement of the protruding part 23*c* in the scanning direction X, contact with an end face EF on the bottom side of the extension-shaped part 33*c* restricts movement in an up-down direction along the plate surface of the positioning member 31. In other words, the end face EF of the extension-shaped part 33*c* of the positioning member 31 functions as an engaging part, and the protruding part 23*c* of the medium support member 20A functions as an engaged part.

Furthermore, the eaves part 25 on the medium support member 20A includes the convex rib 27 that protrudes downward from the eaves surface 25*a* at a position substantially facing the protruding part 23*c* in the up-down direction along the vertical direction Z. The lower surface of the convex rib 27 contacting with the upper side end face EF of the extension-shaped part 33 restricts movement of the positioning member 31 in the up-down direction along the plate surface. In other words, the end face EF of the extension-shaped part 33*c* intersecting the plate surface of the positioning member 31 functions as an engaging part. The convex rib 27 of the medium support member 20A functions as an engaged part.

In one exemplary embodiment, the upstream-side wall 21 and the downstream-side wall 22 of the medium support member 20A are provided substantially orthogonal to the support surface SM. The upstream-side wall 21, the downstream-side wall 22, and the plate surfaces of the positioning members 31 and 32 are attached so as to be parallel. Due to this, the direction normal to the support surface SM is the up-down direction along the plate surface of the positioning members 31 and 32, or namely, the vertical direction Z. In the extension-shaped part 33*c*, the convex rib 27, which functions as an engaged part, contacts the end face EF on the upper side, which functions as an engaging part. The protruding part 23*c*, which functions as an engaged part, contacts the bottom side end face EF functioning as an engaging part. The engaging part and the engaged part are engaged through these contacts, and the support surface SM above the protruding part 23*c* is positioned in the vertical direction Z with reference to the end face EF of the positioning member 31. In other word, the engaging part engages with the engaged part of the medium support member 20, and the support surface SM is fixed in the vertical direction Z, when the engaged part of the medium support member 20 is engaged by the engaging part.

In this manner, in each of the extension-shaped parts 33*a*, 33*b*, 33*c*, 33*d*, and 33*e*, the convex rib 27, which functions as an engaged part, contacts the upper side end face EF, which functions as an engaging part. The protruding parts 23*a*, 23*b*, 23*c*, 23*d*, and 23*e*, which function as the engaged parts, respectively contact the bottom side end face EF functioning as an engaging part. The engaging parts and the engaged parts are engaged through these contacts, and the support surface SM above the protruding part 23*c* is positioned in the vertical direction Z with reference to the end face EF of the positioning member 31. In other words, the positioning member 31 includes an engaging part on the end face EF, and the medium support member 20A includes an engaged part that engages the engaging part. The engaging of the engaging parts with the engaged parts positions the support surface SM in the vertical direction Z. Furthermore, in other words, when the engaging part engages with the engaged part, the support surface SM is positioned in the vertical direction Z.

In one exemplary embodiment, focusing on the protruding part 23*c* among the protruding parts 23*a*, 23*b*, 23*c*, 23*d*, and 23*e*, an end 23*ce* ahead in the moving direction (scanning direction X) moves along the scanning direction X until contacting the positioning member 31. The movement length until the end 23*ce* of the protruding part 23*c* contacts the end face EF of the positioning member 31 is denoted as a length Lx (refer to FIG. 5).

Moreover, as illustrated in FIG. 5, in one exemplary embodiment, while the support surface SM is positioned through the engaged part of the medium support member 20A engaging with the engaging part of the positioning member 31, the medium support member 20A is inserted into the convex part 24*b* of the hook 24, and the positioning member 31 is restricted from moving in the scanning direction X. In other words, the convex part 24*b* of the hook 24 on the upstream-side wall 21 of the medium support member 20A is pushed in the conveyance direction Y by the bending of the lever part 24*a* while the protruding part 23*c* is inserted into the slit SL from above, as illustrated by the double dotted-dashed line in FIG. 5. As illustrated by the bold arrow in FIG. 5, the convex part 24*b* moves up to the position of the rectangular hole 34 in the positioning member 31 by the lever part 24*a* moving in the scanning direction X from a pushed-in state. Due to the movement in the scanning direction X, the convex part 24*b* returns to the original state from the state of being pushed in the conveyance direction Y by the elasticity of the bent lever part 24*a*, and is thus fitted inside the rectangular hole 34 (a so-called snap fit). The convex part 24*b* of the hook 24 fitting inside the rectangular hole 34 restricts movement of the medium support member 20A along the scanning direction X.

In one exemplary embodiment, a projecting part 28 is formed on the protruding parts 23*a*, 23*b*, 23*c*, 23*d*, and 23*e*, which function as the engaged parts. The projecting part 28 is crushed by engaging the end face EF of the positioning members 31 and 32, which function as the engaging parts, and the protruding parts 23*a*, 23*b*, 23*c*, 23*d* and 23*e*, which function as the engaged parts. And, crushing the projecting part 28 is caused by the engaging part engaging with the engaged part. In other words, the projecting part 28 is crushed by the end face EF when the engaging part engaging with the engaged part. At least two among the plurality of protruding parts 23 (here, among the five protruding parts 23*a*, 23*b*, 23*c*, 23*d*, and 23*e*, for example) provided on the medium support member 20A include the projecting parts 28 formed on the upper surface of the protruding parts 23 at different positions in the scanning direction X so that the crushing does not occur simultaneously during the end face EF of the positioning members 31 and 32 engaging with the protruding parts 23. In other word, a first projecting part formed on one of the plurality of protruding parts 23 and a second projecting part formed on the other of the plurality of protruding parts 23 are arranged so that crushing the first projecting part and crushing the second projecting part do not occur simultaneously. In one exemplary embodiment, the projecting part 28 is a rib, including resin, including an upper surface that is a triangular columnar shape with a mountain-shaped ridge extending in the conveyance direction Y, and the positioning members 31 and 32 are plate-shaped members including metal. However, the projecting part 28 may be a different shape or material.

Figure 6:
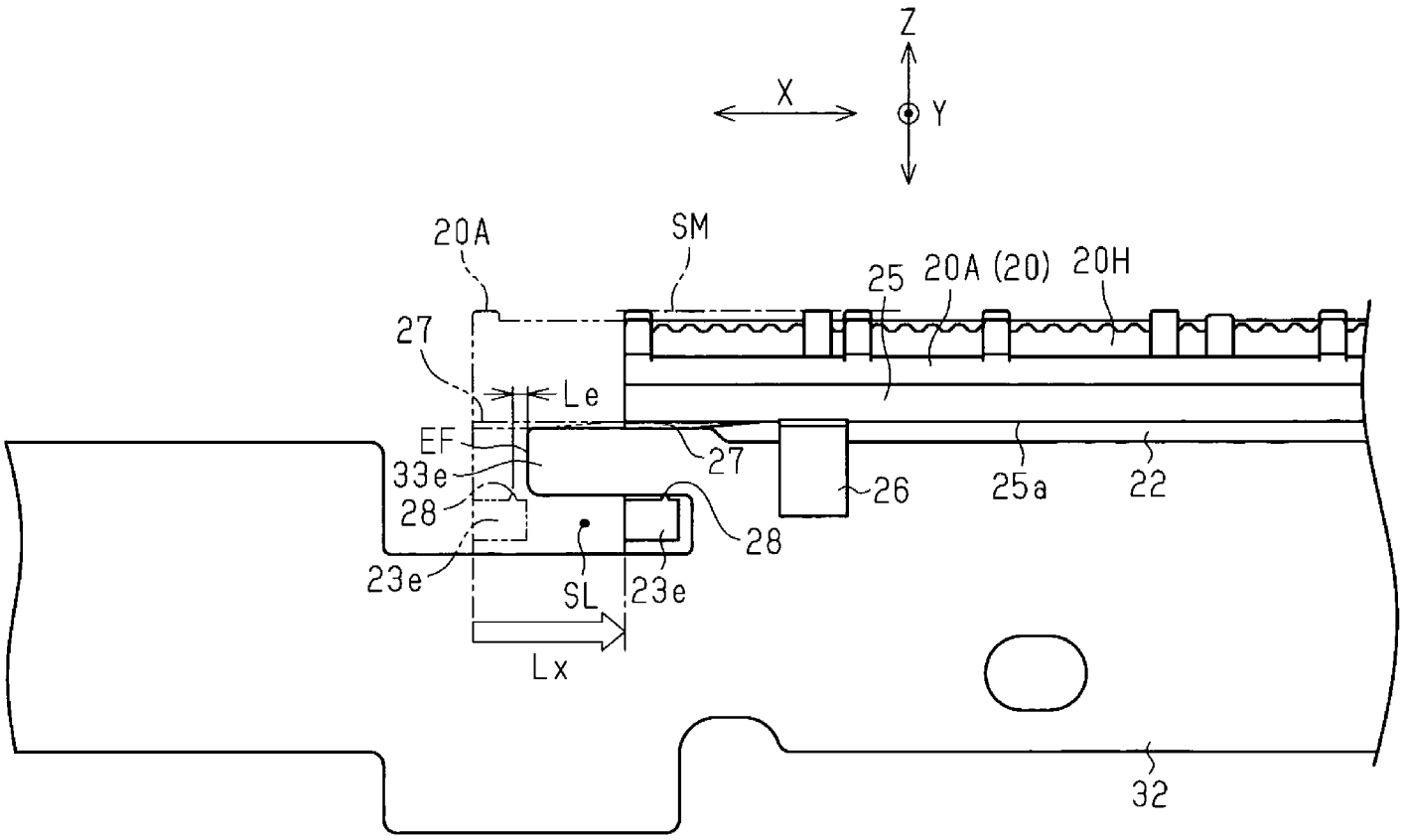
FIG. 6 is a front view illustrating a portion of the medium support member attached to the positioning member.
Figure 7:
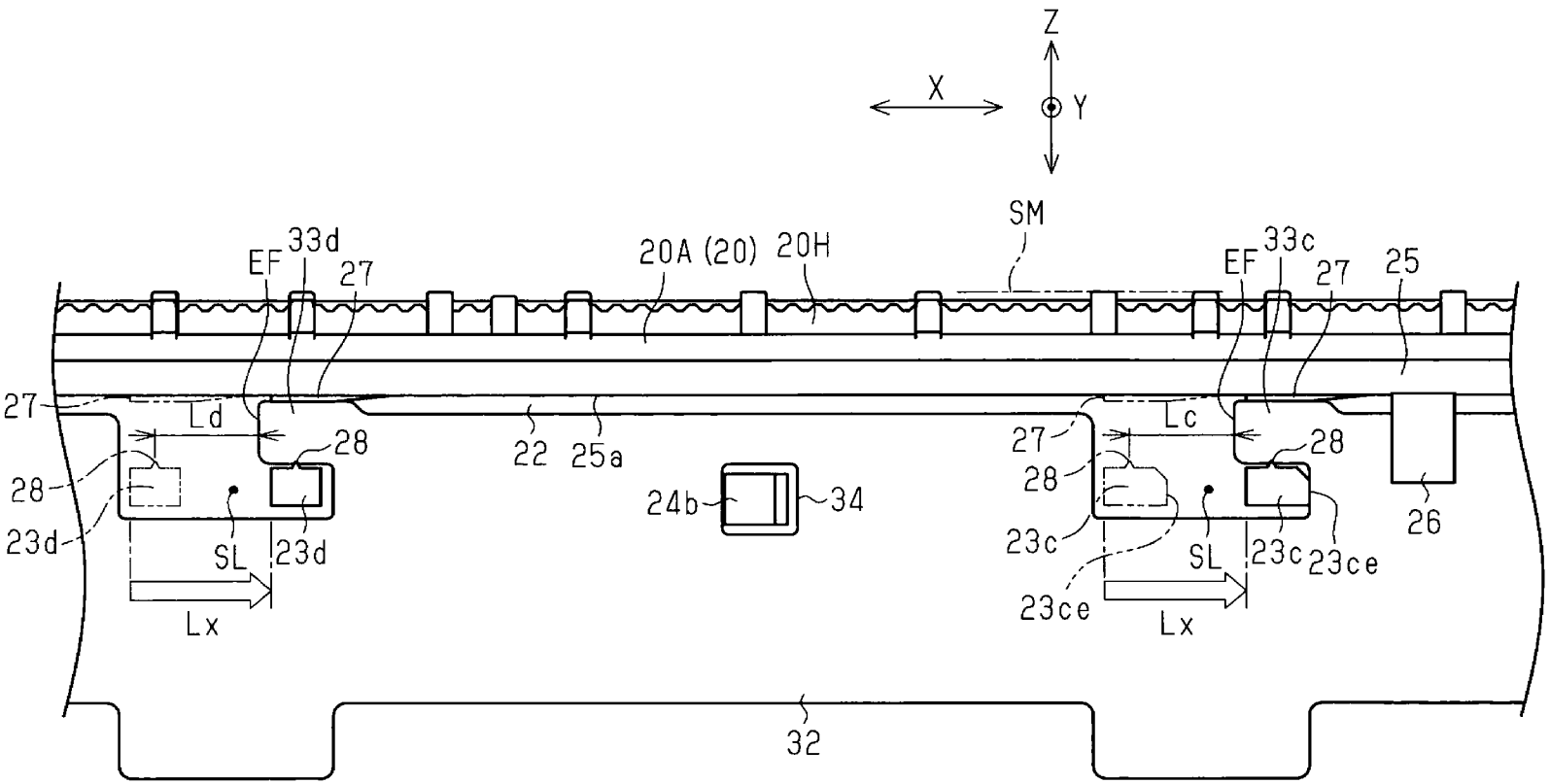
FIG. 7 is a front view illustrating another portion of the medium support member attached to the positioning member.
Figure 8:
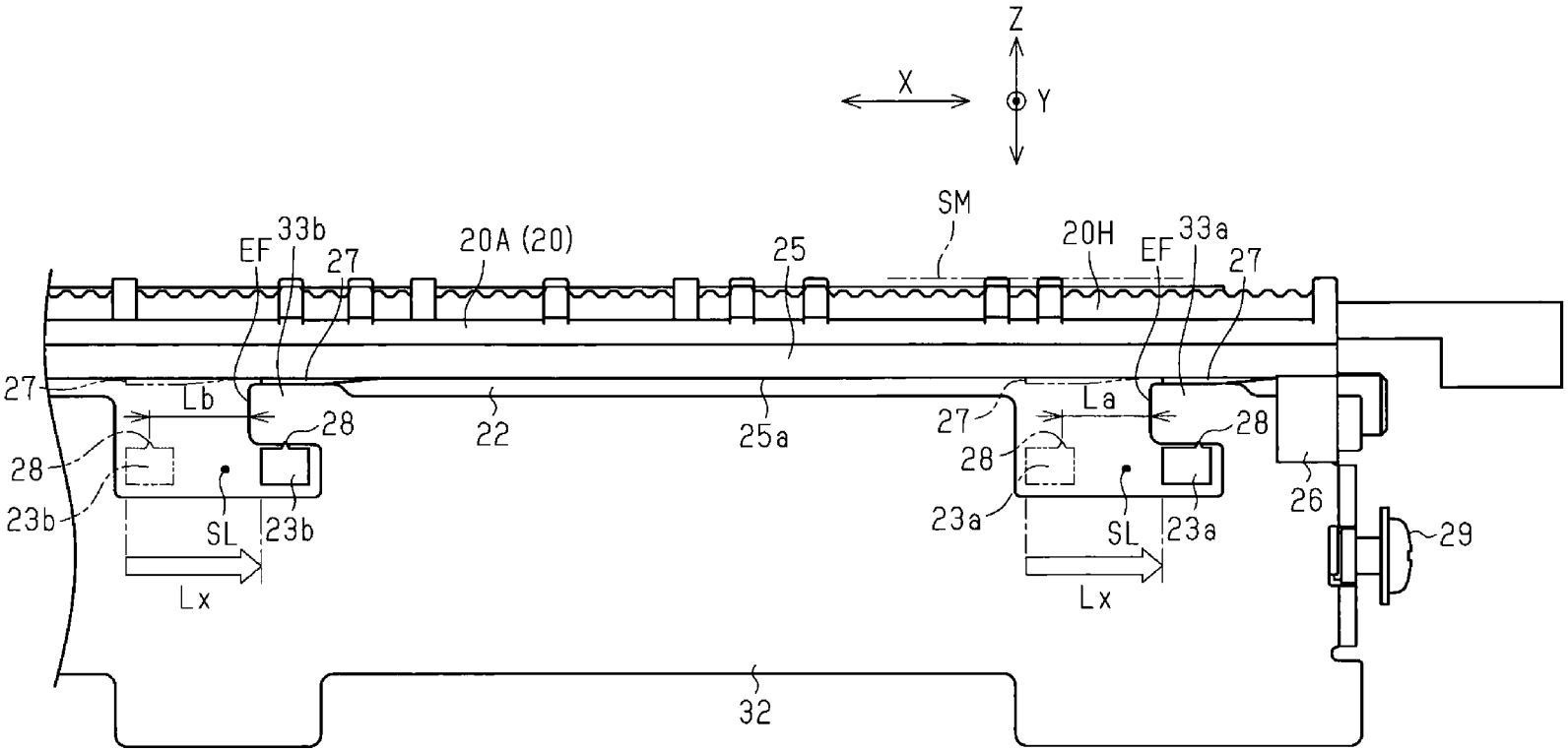
FIG. 8 is a front view illustrating another portion of the medium support member attached to the positioning member.

The projecting parts 28 respectively formed on the five protruding parts 23 protruding in the downstream side in the conveyance direction on the downstream-side wall 22 of the medium support member 20A will be described as one example with reference to FIG. 6, FIG. 7, and FIG. 8. In one exemplary embodiment, the five protruding parts 23 provided on the downstream side-wall 22 of the medium support member 20A are formed from the right side in the scanning direction X in the order of protruding parts 23*a*, 23*b*, 23*c*, 23*d*, and 23*e* seen from the downstream side in the conveyance direction Y, in a similar manner to the five protruding parts 23 formed on the upstream-side wall 21. FIG. 6 illustrates the protruding part 23*e*, FIG. 7 illustrates the protruding parts 23*c* and 23*d*, FIG. 8 illustrates the protruding parts 23*a* and 23*b*, and the projecting part 28 illustrated by the bold line in each drawing is illustrated with the shape prior to crushing.

As illustrated in FIG. 6, the positioning member 32 includes an extension-shaped part 33*e*. The extension-shaped part 33*e* extends in the scanning direction X so as to form a slit SL having an L shape, the top of which is an opening into which the protruding part 23*e* formed on the medium support member 20A can be inserted. When the medium support member 20A is attached to the positioning member 32, the protruding part 23*e* is inserted from above in the vertical direction Z into the inside of the slit SL via the opening.

At this time, in one exemplary embodiment, the protruding part 23*e* is inserted into the inside of the slit SL by moving downward along the end face EF on the scanning direction X side of the extension-shaped part 33*e*. As illustrated by the white arrow in FIG. 6, the protruding part 23*e* inserted into the inside of the slit SL moves a length of the distance Lx in conjunction with movement in the scanning direction X, which is the lengthwise direction of the medium support member 20A.

In the movement of the protruding part 23*e* in the scanning direction X, the convex rib 27 facing the protruding part 23*e* contacts the upper side end face EF of the extension-shaped part 33*e*, and the projecting part 28 on the protruding part 23*e* contacts (engages with) the extension-shaped part 33*e* upon moving a distance Le, thus being crushed by the bottom side end face EF. Thereafter, the protruding part 23*e* moves the distance Lx while the projecting part 28 is crushed by the end face EF. Therefore, the extension-shaped part 33*e* contacts the convex rib 27 and the protruding part 23*e* (specifically, the crushed projecting part 28) in a state in which there is no gap between these in the vertical direction Z (up-down direction). This results in, for the medium support member 20A, the support surface SM above the protruding part 23*e* being positioned with reference to the end face EF of the positioning member 32.

Figure 9:
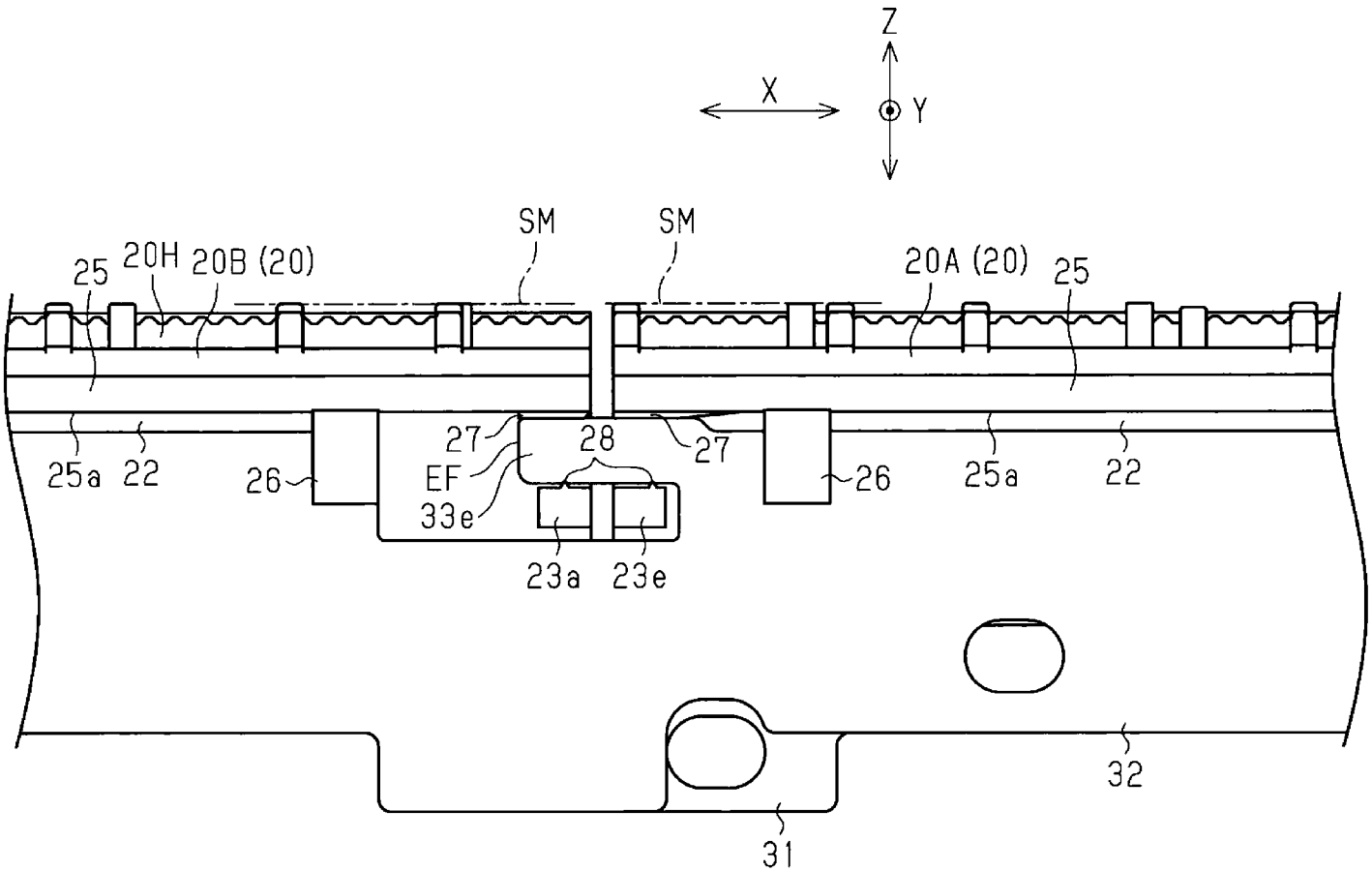
FIG. 9 is a front view illustrating two medium support members attached to the positioning member.

In one exemplary embodiment, both the downstream-side wall 22 of the medium support member 20A and the downstream-side wall 22 of the medium support member 20B are attached to the positioning member 32 on the extension-shaped part 33*e* (refer to FIG. 9). Due to this, the extension length of the extension-shaped part 33*e* is greater than the extension lengths of the other four extension-shaped parts 33*a*, 33*b*, 33*c*, and 33*d* so that both the protruding part 23*e* of the medium support member 20A and the protruding part 23*a* of the medium support member 20B are engageable. Therefore, the distance Lx is a length corresponding to the extension length of the extension-based shape 33*e*.

As illustrated in FIG. 7, the extension-shaped part 33*c* and the extension-shaped part 33*d* are formed on the positioning member 32 each extending in the scanning direction X so as to form a slit SL having an L shape, the top of which is an opening into which the protruding part 23*c* and the protruding part 23*d* formed on the medium support member 20A can be inserted. When the medium support member 20A is attached to the positioning member 32, the protruding part 23*c* and the protruding part 23*d* are each inserted into the inside of the slit SL via the opening. At this time, the protruding part 23*c* and the protruding part 23*d* are inserted into the inside of the slit SL by moving downward through a position separated by a predetermined amount in the scanning direction X from each of the extension-shaped part 33*c* and the extension-shaped part 33*d* in the opening. As illustrated by the white arrow in FIG. 7, the protruding part 23*c* and the protruding part 23*d* inserted into the inside of the slit SL move the length of the distance Lx in conjunction with movement in the scanning direction X, which is the lengthwise direction of the medium support member 20A.

In the movement of the protruding part 23*c* in the scanning direction X, the convex rib 27 facing the protruding part 23*c* contacts the upper side end face EF of the extension-shaped part 33*c*, and the projecting part 28 on the protruding part 23*c* contacts (engages with) the extension-shaped part 33*c* upon moving a distance Lc, thus being crushed by the bottom side end face EF. Thereafter, the protruding part 23*c* moves the distance Lx while the projecting part 28 is crushed by the end face EF. Therefore, the extension-shaped part 33*c* contacts the convex rib 27 and the protruding part 23*c* (specifically, the crushed projecting part 28) in a state in which there is no gap between these in the vertical direction Z (up-down direction). This results in, for the medium support member 20A, the support surface SM above the protruding part 23*c* being positioned with reference to the end face EF of the positioning member 32.

In the movement of the protruding part 23*d* in the scanning direction X, the convex rib 27 facing the protruding part 23*d* contacts the upper side end face EF of the extension-shaped part 33*c*, and the projecting part 28 on the protruding part 23*d* contacts (engages with) the extension-shaped part 33*d* upon moving a distance Ld, thus being crushed by the bottom side end face EF. Thereafter, the protruding part 23*d* moves the distance Lx while the projecting part 28 is crushed by the end face EF. Therefore, the extension-shaped part 33*d* contacts the convex rib 27 and the protruding part 23*d* (specifically, the crushed projecting part 28) in a state in which there is no gap between these in the vertical direction Z (up-down direction). This results in, for the medium support member 20A, the support surface SM above the protruding part 23*d* being positioned with reference to the end face EF of the positioning member 32.

In one exemplary embodiment, the protruding part 23*c* moves the length of the distance Lx, and the end 23*ce* in the scanning direction X which is ahead in the movement direction contacts the positioning member 32. In other words, the distance Lx moved by the medium support member 20A in the scanning direction X is adjustable depending on the length, position, etc. of the protruding part 23*c* in the scanning direction X.

As illustrated in FIG. 8, the extension-shaped part 33*a* and the extension-shaped part 33*b* are formed on the positioning member 32 each extending in the scanning direction X so as to form a slit SL having an L shape, the top of which is an opening into which the protruding part 23*a* and the protruding part 23*b* formed on the medium support member 20A can be inserted. When the medium support member 20A is attached to the positioning member 32, the protruding part 23*a* and the protruding part 23*b* are each inserted into the inside of the slit SL via the opening. At this time, the protruding part 23*a* and the protruding part 23*b* are inserted into the inside of the slit SL by moving downward through a position separated by a predetermined amount in the scanning direction X from each of the extension-shaped part 33*a* and the extension-shaped part 33*b* in the opening. As illustrated by the white arrow in FIG. 8, the protruding part 23*a* and the protruding part 23*b* inserted into the inside of the slit SL move the length of the distance Lx in conjunction with movement in the scanning direction X, which is the lengthwise direction of the medium support member 20A.

In the movement of the protruding part 23*a* in the scanning direction X, the convex rib 27 facing the protruding part 23*a* contacts the upper side end face EF of the extension-shaped part 33*a*, and the projecting part 28 on the protruding part 23*a* contacts (engages with) the extension-shaped part 33*a* upon moving a distance La, thus being crushed by the bottom side end face EF. Thereafter, the protruding part 23*a* moves the distance Lx while the projecting part 28 is crushed by the end face EF. Therefore, the extension-shaped part 33*a* contacts the convex rib 27 and the protruding part 23*a* (specifically, the crushed projecting part 28) in a state in which there is no up-down direction gap between these along the vertical direction Z. This results in, for the medium support member 20A, the support surface SM above the protruding part 23*a* being positioned with reference to the end face EF of the positioning member 32.

In the movement of the protruding part 23*b* in the scanning direction X, the convex rib 27 facing the protruding part 23*b* contacts the upper side end face EF of the extension-shaped part 33*b*, and the projecting part 28 on the protruding part 23*b* contacts (engages with) the extension-shaped part 33*b* upon moving a distance Lb, thus being crushed by the bottom side end face EF. Thereafter, the protruding part 23*b* moves the distance Lx while the projecting part 28 is crushed by the end face EF. Therefore, the extension-shaped part 33*b* contacts the convex rib 27 and the protruding part 23*b* (specifically, the crushed projecting part 28) in a state in which there is no up-down direction gap between these along the vertical direction Z. This results in, for the medium support member 20A, the support surface SM above the protruding part 23*b* being positioned with reference to the end face EF of the positioning member 32.

In one exemplary embodiment, at least two among the plurality of protruding parts 23*a*, 23*b*, 23*c*, 23*d*, and 23*e* provided on the medium support member 20A include the projecting parts 28 formed on the upper surface of the protruding parts 23 at different positions in the scanning direction X so that the crushing does not occur simultaneously during engaging (contacting) of the end face EF by the projecting parts 28. In other words, in the protruding parts 23*a*, 23*b*, 23*c*, 23*d*, and 23*e*, at least two distances differ among the distances La, Lb, Lc, Ld, and Le, which are the movement distances in the scanning direction X of the projecting part 28 until being crushed by the end face EF of the positioning member 31 or the positioning member 32.

In one exemplary embodiment, the distance Le is the shortest. The distance Lb, distance LC, and distance Ld are identical in length, and the distance La is shorter than the distance Lb and longer than the distance Le. As a result, when the medium support member 20A is attached to the positioning member 32 by being moved in the scanning direction X by the length amount of the distance Lx, first the end face EF of the positioning member 32 crushes the projecting part 28 of the protruding part 23*e*, and next, after the projecting part 28 of the protruding part 23*a* is crushed, the three projecting parts 28 of the protrusion parts 23*b*, 23*c*, and 23*d* are crushed at the same time.

Although the explanation has been omitted, the medium support member 20A being attached to the positioning member 31 (refer to FIG. 4) on the upstream side in the conveyance direction Y by moving the length of the distance Lx in the scanning direction is similar to a case in which the medium support member is attached to the positioning member 32 on the downstream side in the conveyance direction Y by moving the length of the distance Lx in the scanning direction X. In other words, first the end face EF of the positioning member 31 crushes the projecting part 28 of the protruding part 23*e*, and next, after the projecting part 28 of the protruding part 23*a* is crushed, the three projecting parts 28 of the protrusion parts 23*b*, 23*c*, and 23*d* are crushed at the same time.

Furthermore, a case in which the medium support member 20B is attached to the positioning members 31 and 32 by moving in the scanning direction X, and a case in which the medium support member 20C is attached to the positioning members 31 and 32 by moving in the scanning direction X, are similar to the case in which the medium support member 20A is attached to the positioning members 31 and 32 in the scanning direction X. In other words, for at least two among the four protruding parts 23 (refer to FIG. 3) respectively provided on the upstream-side wall 21 and the downstream-side wall 22 of the medium support member 20B, the projecting parts 28 are formed on the upper surface of the protruding parts 23 at different positions in the scanning direction X so that the crushing does not occur simultaneously during engaging (contacting) of the end face EF by the projecting parts 28. In an identical manner, for at least two among the four protruding parts 23 (refer to FIG. 3) respectively provided on the upstream-side wall 21 and the downstream-side wall 22 of the medium support member 20C, the projecting parts 28 are formed on the upper surface of the protruding parts 23 at different positions in the scanning direction X so that the crushing does not occur simultaneously during engaging (contacting) of the end face EF by the projecting parts 28. The projecting parts 28 of the respective protruding parts 23 may be formed at different positions in the scanning direction X between the upstream-side wall 21 and the downstream-side wall of the medium support member 20B.

Moreover, in one exemplary embodiment, between two members adjacent on the medium support member 20, a first engaged part is provided on one member and a second engaged part is provided on the other member as engaged parts that are engaged by the engaging parts of the positioning members 31 and 32.

For example, as illustrated in FIG. 9, one member of adjacent members included in the medium support member 20 is the medium support member 20A, which is one example of a first medium support member, and the other member of adjacent members is the medium support member 20B, which is one example of the second medium support member. In this case, between the medium support member 20A and the medium support member 20B, for one extension-shaped part 33*e* functioning as an engaging part of the positioning member 32, the protruding part 23*e* of the medium support member 20A and the convex rib 27 are engaged, and the protruding part 23*a* of the medium support member 20B and the convex rib 27 are engaged. In other words, one extension-shaped part 33*e* engages with the protruding part 23*a* and the protruding part 23*e*. Therefore, the protruding part 23*e* of the medium support member 20A and the convex rib 27 function as the first engaged part, and the protruding part 23*a* of the medium support member 20B and the convex rib 27 function as the second engaged part.

The extension-shaped part 33*e* (engaging part) engaging with the protruding part 23*e* of the medium support member 20A and the convex rib 27 (first engaged part) crushes the projecting part 28 of the protruding part 23*e* at the end face EF of the extension-shaped part 33*e*. Due to the crushing of the projecting part 28 of the protruding part 23*e*, the extension-shaped part 33*e* makes contact in a state in which there is no gap in the vertical direction Z (up-down direction) between the convex rib 27 of the medium support member 20A and the protruding part 23*e*. This results in, for the medium support member 20A, the support surface SM above the protruding part 23*e* being positioned with reference to the end face EF of the extension-shaped part 33*e* of the positioning member 32.

Furthermore, the extension-shaped part 33*e* (engaging part) engaging with the protruding part 23*e* of the medium support member 20B and the convex rib 27 (second engaged part) crushes the projecting part 28 of the protruding part 23*a* at the end face EF of the extension-shaped part 33*e*. Due to the crushing of the projecting part 28 of the protruding part 23*a*, the extension-shaped part 33*e* makes contact in a state in which there is no gap in the vertical direction Z (up-down direction) between the convex rib 27 of the medium support member 20B and the protruding part 23*a*. This results in, for the medium support member 20B, the support surface SM above the protruding part 23*a* being positioned with reference to the end face EF of the extension-shape part 33*e* of the positioning member 32. In other words, for the medium support member 20A and the medium support member 20B, the support surface SM above the protruding part 23*e* and the support surface SM above the protruding part 23*a* are positioned with reference to the end face EF of the single extension-shaped part 33*e*.

Although an explanation has been omitted, this is similar for a case in which the two adjacent members are the medium support member 20B, which is one example of the first medium support member, and the medium support member 20C, which is one example of the second medium support member. In other words, a single extension-shaped part 33 functioning as an engaging part engages both the convex rib 27 and the protruding part 23 of the medium support member 20B functioning as the first engaged part and the convex rib 27 and the protruding part 23 of the medium support member 20C functioning as the second engaged part (refer to FIG. 3).

The advantages of some exemplary embodiments will be described. The plate-shaped positioning members 31 and 32 have strong rigidity against curving (inner surface curving) in the direction along the plate surface, and thus it is possible to suppress the curving of the support surface SM of the sheet of paper RP by positioning the support surface SM of the medium support member 20 with the end face EF, with the direction along the plate surface being denoted as the normal direction of the end face EF. In addition, making the positioning members 31 and 32 out of metal further suppresses curving deformations in the direction along the plate surface.

Furthermore, even in a case where the medium support member 20 includes a long support surface SM in the scanning direction X, the engaging of the plurality of extension-shaped parts 33, the protruding parts 23, and the convex ribs 27 positions the support surface SM in the vertical direction Z, which is a direction normal to the support surface, in a plurality of locations in the scanning direction X. Therefore, the support surface SM can be maintained as a surface for which curving is easily suppressed by the positioning members 31 and 32.

Furthermore, the projecting part 28 of the protruding part 23 is crushed by the end face EF of the positioning members 31 and 32, and thus the medium support member 20 is positioned without gaps in the direction normal to (the vertical direction Z of) the support surface SM. Due to this, the support surface SM is positioned in the direction normal to the support surface with high positioning precision due to the positioning members 31 and 32.

With respect to at least two of the plurality of protruding parts 23, crushing of the projecting part 28 by the end face EF when the extension-shaped part 33 engages with the protruding part 23 and the convex rib 27 does not occur at the same time, and thus when attaching the medium support member 20 to the positioning members 31 and 32, an increase in load during engaging caused by crushing of the projecting unit 28 is suppressed.

Furthermore, a single extensions-shaped part 33 engages the respective protruding parts 23 and convex ribs 27 of two adjacent medium support members 20, and thus the positioning members 31 and 32 can make the support surface SM of two different medium support members 20 into an identical surface for which level differences have been easily suppressed.

Advantages achievable by some of the exemplary embodiments will be described below.

The support surface SM is positioned with reference to the end face EF intersecting the plate surfaces of the positioning members 31 and 32, which are plate-shaped members. The end face EF has a relatively small area and is easy to make into a flat face during processing, and thus it is easy to ensure the flatness of the end face EF as the reference flat surface. This makes it possible to easily form a reference flat surface, which allows for highly precise positioning.

The positioning members 31 and 32 position the medium support member 20 with the end face EF of a plate-shaped member. Curving deformation in the direction normal to the end face EF is suppressed, thus making it possible for the support surface SM of the sheet of paper RP to be a surface for which curving is suppressed. And in addition, the positioning members 31 and 32 include metal, and thus positioning is performed with the plate-shaped end face EF having strong rigidity against curving in the normal direction to the end face EF, which makes it possible for the support surface SM of the sheet of paper RP to be a surface for which curving is easily suppressed.

The engaging of the extension-shaped part 33, protruding part 23, and convex rib 27 positions the medium support member 20 in the direction normal to the support surface SM. Due to this, it is easy for the support surface SM to be a surface for which curving is suppressed.

Furthermore, the protruding part 23 has the projecting part 28 crushed by the end face EF of the positioning members 31 and 32, and thus the medium support member 20 is positioned without gaps in the direction normal to the support surface SM, and thus it is possible for the support surface SM to be a surface for which curving is suppressed.

With respect to at least two of the plurality of protruding parts 23, the projecting part 28 is formed on different positions of the protruding part 23, and thus crushing does not occur at the same time as engaging with the end face EF. In the other words, the projecting part 28 formed on one of the plurality of protruding parts 23 and the projecting part 28 formed on the other of the plurality of protruding parts 23 are arranged so that crushing does not occur simultaneously. And, it is possible to suppress an increase in the workload during engaging via crushing of the projecting part 28 when the positioning members 31 and 32 engage with the medium support member 20.

One extension-shaped part 33 of the positioning members 31 and 32 engages with the protruding parts 23 and convex ribs 27 of two different medium support members 20, thus making it possible for the support surface SM of the two different medium support members 20 to be an identical surface.

Some exemplary embodiments described above may be modified as described in the modification examples below.

In some exemplary embodiments described above, the medium support member 20 does not need to include a plurality of members (for example, the medium support member 20A and medium support member 20B). In other words, in some exemplary embodiments described above, the medium support member 20 may be a single member without being divided.

In some exemplary embodiments described above, one of the extension-shaped parts 33 of the positioning members 31 and 32 does not need to engage both the protruding part 23 and convex rib 27 of the medium support member 20A and the protruding part 23 and convex rib 27 of the medium support member 20B. Alternatively, a single extension-shaped part 33 of the positioning members 31 and 32 does not need to engage both the protruding part 23 and the convex rib 27 of the medium support member 20B and the protruding part 23 and convex rib 27 of the medium support member 20B. In other words, the positioning members 31 and 32 may include a configuration in which a single extension-shaped part 33 engages one convex rib 27 and protruding part 23 of the medium support member 20.

In some exemplary embodiments described above, the projecting parts 28 formed on the plurality of protruding parts 23 may all be formed at different positions without any overlapping of crushing by the end face EF of the extension-shaped part 33. In the other words the projecting parts 28 may be arranged so that each crushing occurs at a timing which is different from all others. Alternatively, the projecting parts 28 formed on the plurality of protruding parts 23 may all be formed in identical positions with all including overlapping of crushing by the end face EF of the extension-shaped part 33.

In some exemplary embodiments described above, the protruding part 23 does not need to include a projecting part 28 that is crushed by the end face EF when engaging the extension-shaped part 33. In this case, the extension-shaped part 33 may be set such that the gap between the protruding part 23 and the convex rib 27 is zero or a markedly small predetermined dimension or lower.

In some exemplary embodiments described above, the support surface M need not be positioned in the direction normal to the support surface SM by the engaging of the extension-shaped part 33, protruding part 23, and convex rib 27. For example, the support surface SM may be positioned in a direction that is inclined with respect to the direction normal to the support surface SM by the engaging of the extension-shaped part 33, protruding part 23, and convex rib 27. In other words, in the medium support member 20, in a case where the wall surface of the upstream-side wall 21 or downstream-side wall 22 is a surface that is inclined with respect to a direction normal to the support surface SM, the positioning member 31 or the positioning member 32 to which the wall surface of the upstream-side wall 21 or the downstream-side wall 22 is attached positions the support surface SM of the medium support member 20 in a direction that is inclined with respect to the normal direction.

In some exemplary embodiments described above, the positioning members 31 and 32 may include a material other than metal. For example, the positioning members may include resin, carbon, ceramic, or the like.

In some exemplary embodiments described above, the shape of the projecting unit 28 may be a shape other than a triangular columnar shape. For example, the shape may be a semi-columnar shape. The shape of the projecting unit 28 is not limited to a rib shape, and may be a pyramid shape, a dot shape that is a hemispherical shape, or the like.

In some exemplary embodiments described above, the printing apparatus 11 may be a serial type printer in which the liquid jetting head 19 moves back and forth with the cartridge 18 in the direction along the guide shaft, or a line type printer in which ink is jetted from a fixed liquid jetting head 19 onto the sheet of paper RP. Furthermore, the printing apparatus 11 may be a printer that prints an image or the like containing a character, pattern, etc. by jetting ink onto a roll paper, or a printer that prints an image or the like containing a character, pattern, etc. by jetting ink onto a cut paper CP.

In some exemplary embodiments described above, the printing apparatus 11 may be an on-cartridge type that holds on the cartridge an ink tank in which ink to be supplied to the liquid jetting head 18 is stored, or the printing apparatus may be an off-cartridge type in which the ink tank is disposed in a position that is not on the cartridge.

The liquid jetted by the liquid jetting head 19 is not limited to ink, and may be a liquid body or the like in which particles of a functional material have been dispersed or mixed into the liquid. For example, printing may be performed by jetting a liquid body containing, in a dispersed or melted form, a material such as an electrode material or color material (pixel material) used in the manufacturing etc. of liquid crystal displays, EL (electroluminescent) displays, and light-emitting displays.

The present application claims priority to Japanese Application NO. 2017-147019, filed on Jul. 28, 2017, which is hereby incorporated by reference in its entirety.

What is claimed is:

1. A printing apparatus, comprising:

a medium support member including a support surface configured to support a medium on which printing is to be performed; and a positioning member configured to position the support surface of the medium support member, wherein the positioning member is a plate-shaped member, and the positioning member is configured to position the support surface of the medium support member, with the medium support member contacting with an end face of the positioning member, the end face of the positioning member intersecting a plate surface of the positioning member, wherein the end face of the positioning member includes an engaging part, the medium support member includes an engaged part, with which the engaging part engages, and the support surface is positioned in a direction normal to the support surface, when the engaged part is engaged by the engaging part.

2. The printing apparatus according to claim 1, wherein the positioning member comprises metal.

3. The printing apparatus according to claim 1, wherein the medium support member comprises resin, the engaged part includes a projecting part, and the projecting part is crushed by the end face of the positioning member during the engaging part is engaging with the engaged part.

4. The printing apparatus according to claim 3, wherein the medium support member includes a plurality of engaged parts, one of the plurality of engaged parts including a first projecting part as the projecting part, and the other of the plurality of engaged parts including a second projecting part as the projecting part, and the first projecting part and the second projecting part are arranged so that crushing the first projecting part and crushing the second projecting part do not occur simultaneously, the crushing the first projecting part and the crushing the second projecting part being caused by the engaging part engaging with the engaged part.

5. The printing apparatus according to claim 4, wherein the medium support member includes a first medium support member and a second medium support member, the first medium support member includes a first engaged part, the second medium support member includes a second engaged part, and the engaging part of the positioning member engages with the first engaged part and the second engaged part.

6. The printing apparatus according to claim 3, wherein the medium support member includes a first medium support member and a second medium support member, the first medium support member includes a first engaged part, the second medium support member includes a second engaged part, and the engaging part of the positioning member engages with the first engaged part and the second engaged part.

7. The printing apparatus according to claim 3, wherein the medium support member includes a first medium support member and a second medium support member, the first medium support member includes a first engaged part, the second medium support member includes a second engaged part, and the engaging part of the positioning member engages with the first engaged part and the second engaged part.

* * * * *